United States Patent [19]

Davis

[11] 3,994,549

[45] Nov. 30, 1976

[54] FLEXIBLE WALL STORAGE SYSTEM

[75] Inventor: Donald A. Davis, Winchester, Mass.

[73] Assignee: Interflex Systems, Inc., Arlington, Mass.

[22] Filed: June 20, 1975

[21] Appl. No.: 588,838

[52] U.S. Cl. ..... 312/253; 312/341 R; 312/350

[51] Int. Cl.[2] ..... A47B 85/00; A47B 47/00

[58] Field of Search ..... 312/240, 249, 250, 257 R, 312/309, 341, 342, 350; 248/188.2; 16/164

[56] References Cited

UNITED STATES PATENTS

| | | | |
|---|---|---|---|
| 2,101,852 | 12/1937 | Hammer | 312/249 |
| 2,620,251 | 12/1952 | Restivo | 312/257 R |
| 2,742,675 | 4/1956 | Robertson | 312/253 |
| 3,001,224 | 9/1961 | Soss | 16/164 |
| 3,393,846 | 7/1968 | Cannon et al. | 248/188.2 |
| 3,700,300 | 10/1972 | Davis | 312/240 |

*Primary Examiner*—Casmir A. Nunberg
*Attorney, Agent, or Firm*—Donald D. Jeffery

[57] ABSTRACT

A modular flexible wall storage system comprised of a series of cabinets each of which is constructed to be readily adaptable to drawer or shelf storage, as desired by the purchaser. Vertical standards are mounted on the vertical walls of the cabinet and drawer or shelf supporting hardware is alternatively mounted on the standards to support the shelves or the drawers, with the hardware for the latter, and support means mounted on the drawers, permitting relatively frictionless sliding movement of the drawer inwardly and outwardly of the cabinet. Doors can be mounted on the cabinet quickly and easily and can be pivoted a full 180° so as not to extend into the traffic area in front of the system when the doors are fully open. The cabinets are supported on a support assembly which includes leveling means permitting levelling of the support assembly prior to installation of the system thereby compensating for unevenness in the floor or other supporting surface on which the system is installed. The support system is constructed so as to minimize damage to carpeting where the system is installed over carpeting.

11 Claims, 7 Drawing Figures

FLEXIBLE WALL STORAGE SYSTEM

BACKGROUND OF THE INVENTION

The present invention relates as indicated to a flexible wall storage system and relates more particularly to a storage system in the form of a cabinet in which the component parts thereof can be quickly and easily interchanged to provide a great many storage arrangements basically including drawer storage and shelf storage, with the latter normally being in combination with a door hinged to the cabinet.

The present invention constitutes an improvement over the cabinet construction disclosed in U.S. Pat. No. 3,700,300 granted on Oct. 24, 1972, to Donald A. Davis and Anthony Galluzzo, and entitled "Modular Cabinet Construction." Although the modular concept and the structure disclosed in the patent in furtherance of such concept are highly satisfactory, certain drawbacks do exist from a manufacturing standpoint. The guides which extend from the front to the rear of the cabinet and which function to guide and support the drawers, where drawer storage is desired, or support shelves, for shelf type storage, were constructed of wood which substantially increased both the material cost for the cabinet as well as the labor factor required in mounting the wood guides on all supporting walls of the cabinet. In order to receive the wood supporting guides, the drawers were formed with recesses in the side walls thereof, and the formation of such recesses also constituted an additional labor factor, and the desired interfitting of the drawer and the guide therefor required fairly close tolerances.

SUMMARY OF THE PRESENT INVENTION

A primary object of the present invention is to provide a flexible wall storage system in the form of a modular cabinet the construction of which permits the cabinet to be adapted to, or subsequently converted to, either drawer or open storage, with the latter term being interpreted in the present specification to mean an entirely open storage area or an area in which shelves are vertically spaced to divide the area into a series of storage compartment. In accordance with the invention, vertical standards are mounted on each vertical supporting wall of the cabinet during manufacture thereof and drawer guide components can be mounted on the vertical standards for drawer type storage. Shelf supporting hardware can be mounted either on the standards or directly on the vertical walls of the cabinet to support the shelves. In either instance, the hardware employed for supporting either the shelves or the drawers can be quickly and easily mounted and vertically spaced as desired. The vertical standards are of metal as are the supporting components for the shelves and drawers, except for rollers which support the sliding movement of the drawers, which rollers are preferable formed of plastic material. In this manner, the material cost of the cabinet is substantially reduced as is the labor required to manufacture the cabinets to accommodate the desired alternative storage arrangements.

A still further object of the present invention is to provide a leveling system for the wall storage cabinet by means of which a level surface can be provided at each corner of the cabinet before the same is installed. In this matter, the entire system, which normally comprises a series of adjacently positioned individual cabinets, can be leveled thereby to compensate for uneven floors or the supporting surfaces, which commonly occurs and causes a definite problem. By leveling the supporting surface for the storage system, smooth and unrestricted movement of the drawers and the opening and closing of doors is assured.

Yet another object of the present invention is to provide a storage system which is not only economical to manufacture but which can be adapted or converted to drawer or open storage without the use of tools. The hardware which supports the drawers is removably mounted on the vertical standards which are attached to the walls of the cabinet, and the hardware can be quickly removed or vertically relocated by disengaging the same from the vertical standards.

A further object of the present invention is to provide a mounting for a door which permits the door to be rotated 180° from a closed position to a fully open position thereby not extending into the traffic area in front of the cabinet. The mounting means is in the form of a hinge which can be quickly mounted and secured in openings provided therefor in the adjacently disposed end walls of the cabinet and the door to be mounted.

These and other objects of the invention will be apparent as the following description proceeds in particular reference to the application drawings.

BRIEF DESCRIPTION OF THE APPLICATION DRAWINGS

FIG. 1 is a front elevational view of one cabinet of the flexible wall storage system of the present invention, with a door appearing on the right of the cabinet and the drawer suspension system on the left, the drawers being omitted from this figure;

FIG. 2. is a fragmentary view showing a section of a drawer and means for slidably supporting the same;

DETAILED DESCRIPTION OF THE PREFERRED EMBODIMENTS

Figure 1:
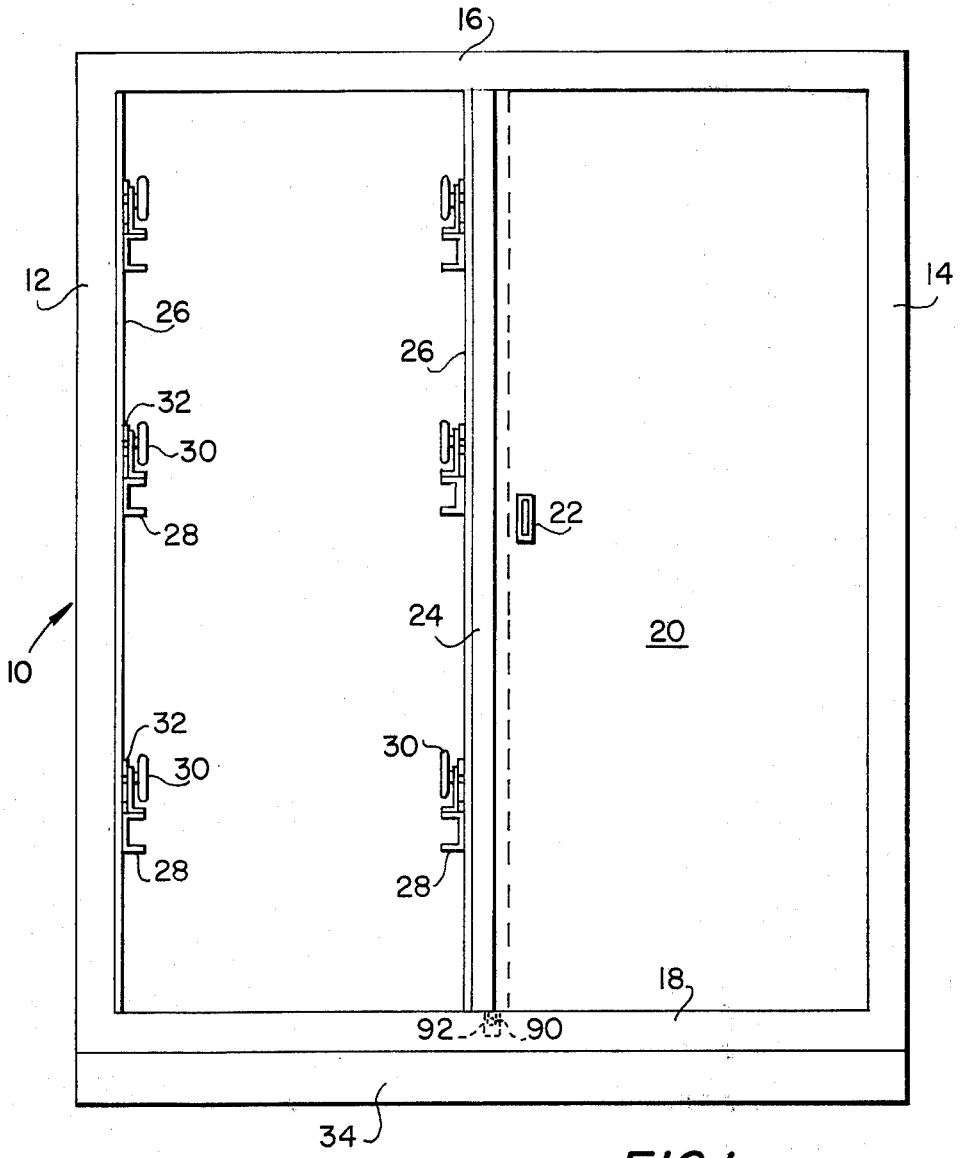

Referring now in more detail to the drawings, wherein like parts are indicated by like reference numerals, and initially to FIG. 1, the flexible wall storage system constructed in accordance with the present invention is normally formed from a series of modular cabinets of the type generally indicated at 10 in FIG. 1. The cabinet includes sidewalls 12 and 14, a top wall 16 and a bottom wall 18 which are secured to each other in the manner shown to form an open storage area or cabinet. In the FIG. 1 cabinet form, a door 20 is shown mounted at the right side of the cabinet, with the door being hinged at its right side to the cabinet in a manner to be hereinafter described when particular reference is made to FIGS. 4 and 6 of the application drawings. A pull 22 is mounted in a recess formed therefor in the door 20 for moving the same between open and closed positions. In FIG. 1, the left hand side of the cabinet is shown open to expose the drawer and shelf supporting components which are shown mounted on the sidewall 12 and a vertical dividing partition 24 mounted in the cabinet generally intermediate the sidewalls 12 and 14. The support system includes vertical standards commonly designated at 26 which are attached by screw fasteners or the like to the vertical wall members, with two such vertical standards preferably being provided on each wall spaced from each other in a direction front to rear of the cabinet. The standards 26 are preferably mounted directly across from each other on the walls 12 and 24 to stabilize the support for the drawers and the shelves where the latter are alternatively provided, where the shelf hardware is mounted on the standards. Although a vertical standard 26 is shown mounted on only one surface of the vertical partition 24, it will be understood that a similar standard is mounted on the opposite side thereof, which is shown in dashed lines in FIG. 1, and that standards are likewise provided on the inner surface of sidewall 14, with a pair of such standards again preferably being provided for each wall in the manner just described. The vertical standards 26 are mounted on all supporting vertical walls of the cabinet regardless of whether the cabinet is to be arranged for drawer storage or open storage in which a door similar to door 20 is preferably provided to close that storage area. By providing vertical standards in all instances, the cabinet can be easily converted to the desired type of storage by simply mounting appropriate hardware depending on purchaser preference and selection.

In the FIG. 1 form, the open cabinet area at the left hand side of this figure has been adapted to receive drawers which are not shown in this figure to permit the drawer suspension system to be more clearly viewed. The drawer suspension system includes drawer guides commonly designated at 28 which are removably mounted on the standards 26 at the desired level to receive the drawers. Mounted on the standards 26 just above the drawer guides 28 are rollers 30 which are carried by support brackets 32 which likewise can be quickly and esily removably mounted from the standards 26, with the rollers 30 serving to support the drawer in a relatively frictionless manner as will be presently described. As shown in FIG. 1, there are three opposed pairs of drawer guides 28 and rollers 30, with each pair being mounted on the vertical standards 26 at the same elevation to provide a level guide and support for the drawers. It will be noted that the drawer guides 28 and rollers 30 are mounted with equal spacing therebetween in order to emphasize an important feature of the present invention which resides in the flexibility achieved in the modular concept. The drawers are preferably provided in heights having 4 inches increments, for example, the drawers are either 4 inches in height, 8 inches in height, 12 inches in height, etc. as desired, and the cabinet 10 is dimensioned to accommodate such modular concept. The positioning of the drawer guides 28 and rollers 30 on the vertical standards 26 will of course depend upon the size and vertical orientation of the drawers, and the spacing as shown in FIG. 1 illustrates the guides and rollers in position to receive 4 inches, 8 inches and 12 inches drawers, referring to the positioning from top to bottom in such figure.

Figure 7:
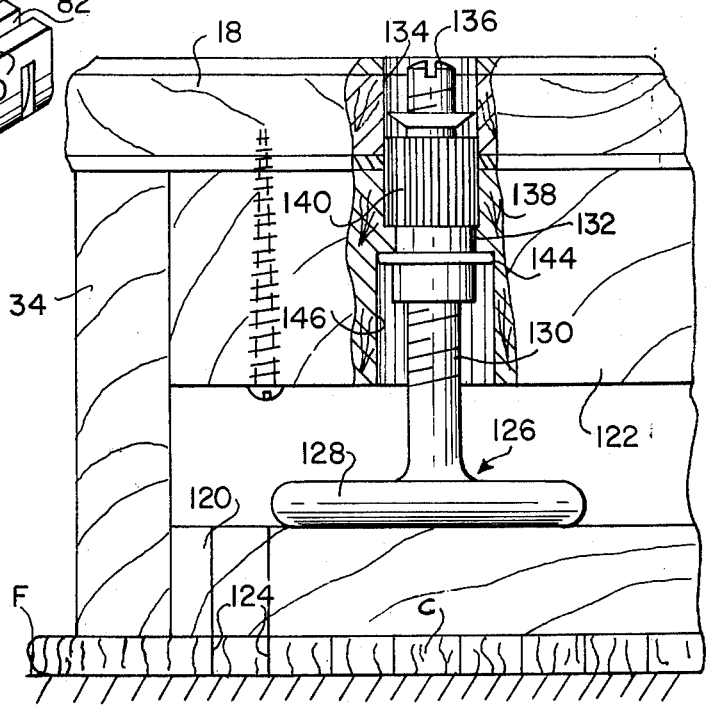
FIG. 7 is a fragmentary, front-elevational view of the leveling system for the cabinet.

Positioned below the bottom wall 18 of the cabinet is a supporting system for the cabinet, including a finish base member 34 which is secured to leveling components for the cabinet and which will be described in detail when particular reference is made to FIG. 7 of the application drawings.

Figure 2:
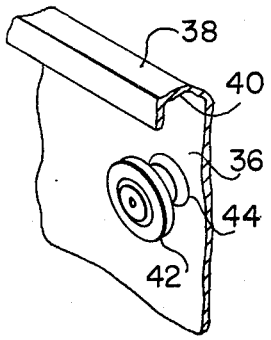

Referring to FIG. 2, there is illustrated therein a fragmentary perspective view of a cabinet drawer which is conventional except for the features thereof shown in FIG. 2. The drawer is preferably formed with metal sides 36, a back and bottom and preferably a wood or plastic front to match the decor of the cabinet. FIG. 2 illustrates the left side of the drawer and it will be understood that the right side is contructed in the same manner. The top of the sidewall 36 of the drawer is formed with the laterally extending flange 38 which is bent to form a generally semi-circular track 40 for receiving the rollers 30 thereby guidably supporting the drawer at both sides thereof. Positioned below the flange 38 and attached to the sidewalls are rollers 42 which are mounted on the sidewalls in any suitable manner such as, for example, by a roller support member 44 which is secured directly to the sidewall. The spacing of the rollers 42 relative to the flange 38 is such that the rollers 42 are positioned in the drawer guides 28 for further supporting the slidable mounting of the drawer. Thus, when the drawer is properly positioned for sliding movement in the cabinet, the drawer is supported both by the guides 28 and the flange 38 thereby providing a stable suspension for the drawer and permitting sliding movement by the door with a minimum of friction. Although only one roller 42 is illustrated in FIG. 2, it will be apparent that more than one roller can be provided, and in the preferred form a pair of such rollers are mounted on each drawer side suitably spaced from front to rear thereon and in the same horizontal plane. It will be noted that where drawers having wood side walls are employed, rollers 42 can be mounted thereon and a flange similar to glange 38 can be mounted at the desired height on the drawer side walls to provide the same slidable support for the drawer.

Figure 3:
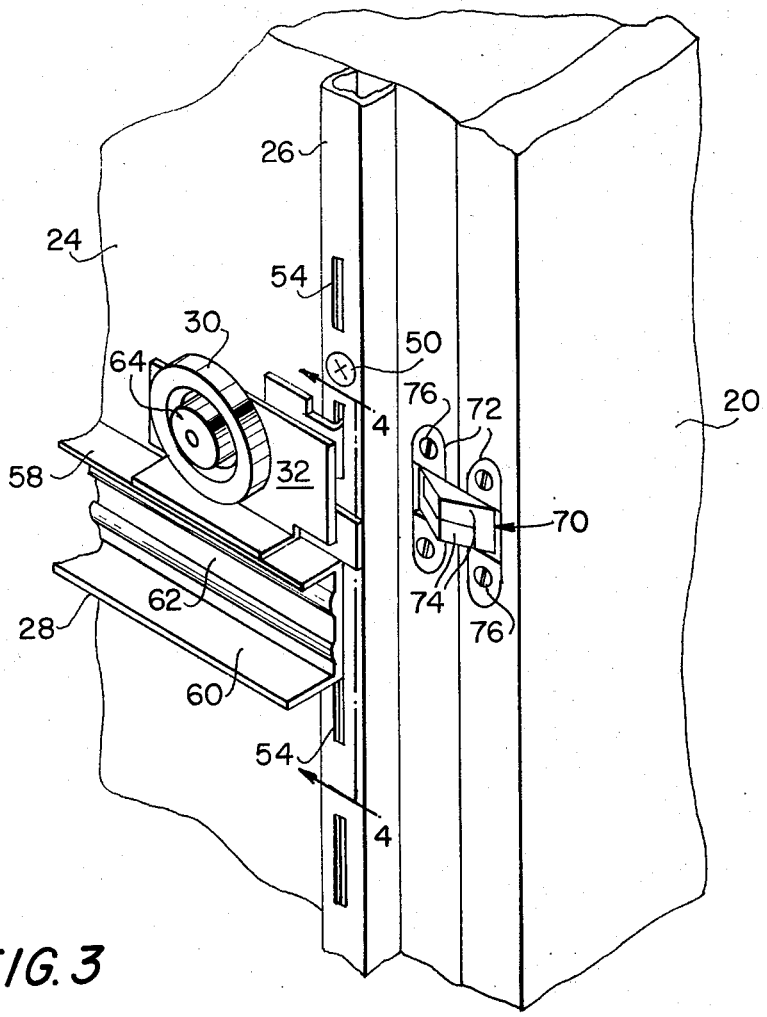
FIG. 3 is a fragmentary view through a section of the cabinet, showing in more detail the drawer suspension means mounted on the interior of the cabinet and the hinge means for a door.
Figure 4:
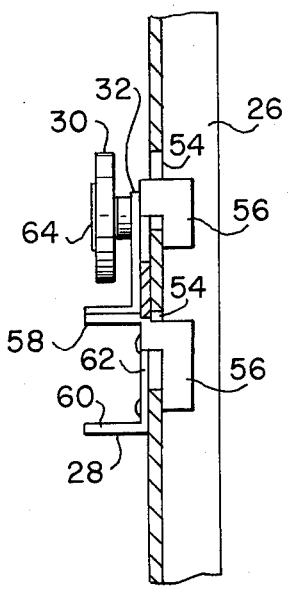
FIG. 4 is a vertical sectional view of line 4—4 of FIG. 3 showing the manner in which the drawer suspension means are removably carried on the cabinet.

Referring to FIGS. 3 and 4, FIG. 3 is a perspective fragmentary view showing in more detail the manner in which the drawer support structure is mounted on the vertical standards 26. FIG. 4 is a sectional view through the standard and drawer guide and roller support members, and from these figures it will be seen that each standard 26 is generally U-shaped in cross section and is secured to the adjacent cabinet wall by means of screws 50 which are provided in sufficient number and vertically spaced to firmly mount the standard to the wall. The front face 52 of the standard is formed with vertically spaced slots 54 for removably receiving tabs formed on the drawer guides 28 and the bracket 32 which supports the roller 30. The tabs are commonly designated at 56 and are spaced from the vertical sections of the drawer guides and bracket 32 to accommodate the thickness of the front wall of the standards so that the tabs can extend through the slots 54 and be dropped for removably mounting the tabs and the brackets and guides to the standards 26. The drawer guides 28 are generally U-shaped in cross section and include upper and lower flanges 58 and 60, respectively, and an intermediate connecting web 62, all of which define a channel or track for receiving the roller 42. The bracket 32 extends laterally from the standard directly above the drawer guide and a roller shaft 64 is mounted on the bracket for rotatably mounting the supporting roller 30. Although only the front mounting of the drawer guide to the standard 26 is illustrated in FIG. 3, it will be understood that the drawer guide is additionally suspended relatively adjacent the rear end thereof in the same general manner, with the standards 26 being spaced on the wall 26 to accommodate the spacing of the tabs 56 which are formed on the drawer guide 28 at the time of manufacture.

Figure 6:
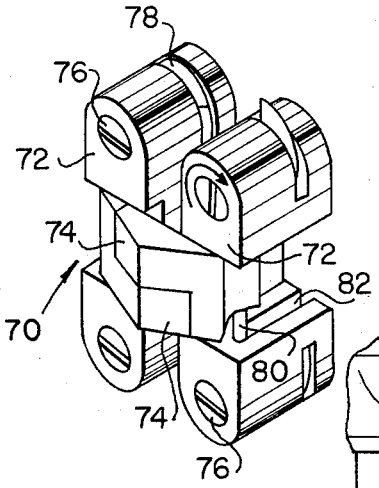
FIG. 6 is a perspective view of the door hinge, with parts being broken away to show the interior construction of the hinge.

The manner in which the door 20 is hinged to the cabinet is also shown in FIG. 3, and the details of the hinge are shown in FIG. 6. It will be noted that for purposes of illustration FIG. 3 shows both drawer supporting structure and a hinged door, although it will be understood that only a door can be employed where it is desired to close a storage area with or without shelves.

The hinge is generally indicated at 70 and includes mounting sections commonly designated at 72 which are essentially identical in construction and leaf sections commonly designated at 74 which extend between and are operatively connected to the mounting sections 72. In order to receive the mounting sections 72, the door 20 and the cabinet wall to which the door is mounted are preformed with openings complementary in shape to the mounting sections whereby the latter can be positioned therein, with the exposed surfaces of the mounting sections being flush with the surfaces of the door and cabinet wall. Referring to FIG. 6, mounting screws commonly designated at 76 are provided adjacent the upper and lower ends of each mounting section and carry eccentrically mounted tabs 78 which during the positioning of the mounting sections within the preformed openings therefor are located within the confines of the hinged sections. When the mounting sections are in position, the rotation of the mounting screws 76 serve to rotate the eccentric tabs 78 so as to move the same outside the plane of the hinged surfaces for engaging the walls of the door and cabinet wall which form the openings for receiving the mounting sections. In this manner the tabs are embedded in such wall thereby preventing inadvertent removal of the hinge while at the same time permitting intentional removal of the hinge simply by rotating the mounting screws 76 in the opposite direction. In this manner, if the cabinet is to be converted from drawer to door storage, for example, the door and cabinet wall to which the door is to be attached can be quickly adapted to receive the hinge. If the hinge is subsequently removed, the opening previously provided therefor in the cabinet wall can be plugged or otherwise filled as desired.

Each leaf section 74 has mounted at the ends thereof pins 80 which travel in slots 82 of the mounting sections 72 to permit sliding movement of the leaf sections to accommodate opening and closing of the door. An important feature of the hinge is that it permits the door 20 to be rotated 180° whereby the same when opened is in a plane generally parallel to a plane containing the door when closed. Thus, the access or traffic area in front of the cabinet or entire storage system is not significantly affected, as contrasted with a hinge mounting which permits rotation of the door only through 90°.

Figure 5:
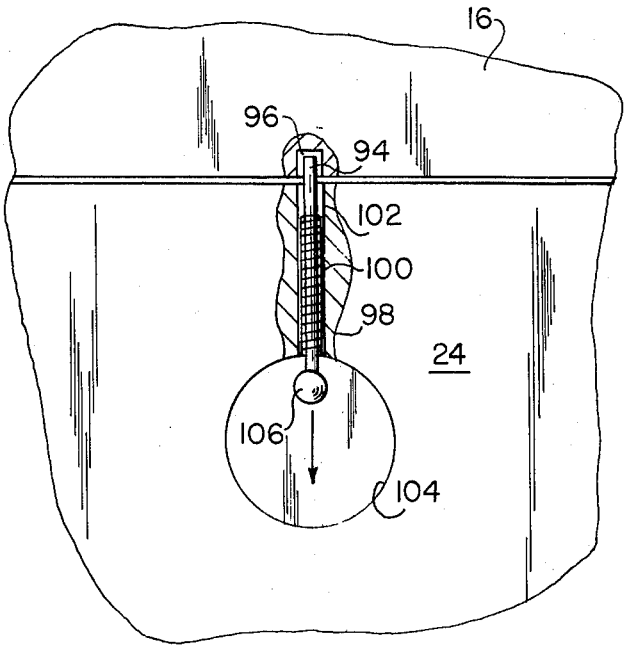
FIG. 5 is a fragmentary view showing the manner in which the vertical divider is removably mounted in the cabinet.

Referring now to FIG. 5, there is illustrated therein the manner in which the vertical partition 24 is removably mounted in the cabinet between the top wall 16 and the bottom wall 18 (not shown). It will be understood that the vertical partition is employed for the purpose of dividing the storage arrangement for the cabinet and can be eliminated entirely it the cabinet is to receive drawers which extend the full width of the cabinet or if the interior of the cabinet is designed only for open storage, with or without shelves, in which event vertical standards 26 and appropriate hardware are mounted on the interior surfaces of the sidewalls 12 and 14. Although not shown in the application drawings, a horizontal partition can be removably mounted in the cabinet in the same manner as partition 24 where it is desired to divide the storage area vertically.

Referring briefly to FIG. 1, the bottom of the partition 24 is formed with pins 90 which extend into openings 92 provided therefor in the bottom wall 18 thereby centering and supporting the partition at the bottom of the cabinet. Referring to FIG. 5, the top of the partition is removably secured to the top wall 16 of the cabinet by pins 94 which extend into openings 96 provided therefor in the upper wall 16. The pins are biased vertically upwardly by means of springs 98, with both the pin and the spring being positioned in a housing member 100 which is mounted in an opening 102 in the partition wall. A finger hole 104 is formed in the partition for providing access to the lower section 106 of the pin which is exposed in the hole 104. The pin 94 is biased by the spring 98 upwardly so that the upper end of the pin 94 is positioned in the opening 96 thereby retaining the partition in place within the cabinet. When it is desired to remove the partition, the end 106 of the pin is retracted against the bias of the spring 98 thereby disengaging the upper end of the pin from the opening 96 to permit removal of the partition from the cabinet. Although only one pin and finger hole is shown in FIG. 5, a second pin and finger hole is preferably provided in the partition spaced toward the rear of the wall.

As above noted, an important feature of the present invention comprises a leveling system for the cabinet 10 whereby the cabinet, and other cabinets similar to cabinet 10, which when combined constitute a wall storage system, can be installed in perfectly level condition. The leveling system is also adapted to permit leveling of the supporting structure for the cabinets subsequent to installation of the storage system, with such leveling being necessary in those situations where settling may have occurred subsequent to such installation. Referring to FIG. 7, the leveling system comprises a floor runner 120 which preferably extends longitudinally the entire length of the storage system, and support shoes 122 secured to the bottom wall 18 and positioned in spaced relation above the floor runner conveniently at each corner of the cabinet. Although only one floor runner 20 is illustrated in FIG. 7, a similar runner is preferably provided at the other face of the system for supporting the shoes 122 in such region.

In many installations, the wall system is installed over carpeting, and in order to minimize or eliminate damage to the carpeting in the event the wall storage system is subsequently removed or relocated, a plurality of nails commonly indicated at 124 are inserted through the floor runner and extend therebelow for engagement with the floor F or other supporting surface. The nails extend through the carpet C thereby to space the floor runner from the floor F so as to prevent matting of the carpet C and to eliminate the carpet as a supporting member of the system. If the storage system is to be installed directly on the floor, the nails can be eliminated and tape provided between the floor runner and the floor to prevent lateral shifting of the cabinet.

A leveling means generally indicated at 126 is provided for vertically adjusting the shoe 122 relative to the floor runner 20 whereby the top surface of all four shoes, in the event a shoe is located adjacent each corner of the cabinet, can be positioned in the same horizontal plane. The leveling means 126 includes a foot portion 128 which is positioned on the floor runner, and a vertical shaft portion 130 which extends upwardly through an opening 132 provided therefor in the central region of the shoe. The shaft 130 is threaded and the free end thereof terminates in an opening 134 formed in the bottom wall 18 of the cabinet, with the end of the shaft being slotted as indicated at 136 for rotation of the leveling means.

The shoe is formed with a central opening 138 for receiving an internally threaded knurled nut 140 which is driven into the walls of the opening 138 and the walls defining the opening 134 in the cabinet wall for preventing relative rotation of the nut while permitting vertical adjustment of the leveling means. The nut is formed with a bottom peripheral flange 144 which engages the bottom of the counterbore 146 found in the shoe for limiting the penetration of the nut into the shoe.

Thus, when the shaft 130, which is threaded within the nut 140, is rotated through the slotted end 136 thereof, the leveling means 126 moves upwardly or downwardly, depending upon the direction of rotation, thereby lowering or raising the shoe 122 and the cabinet to which it is secured. In this manner, each corner of the cabinet can be positioned at the same elevation thereby providing a level support for the cabinet. When the cabinet is installed, the openings 134 in the bottom wall 18 are located so as to receive the upper ends of the shafts 130. If subsequent leveling is necessary to compensate for settling of the supporting surface, such leveling can be made as above described since the shaft 130 is exposed for adjustment purposes at the openings 134.

The finish base member 34 is secured to the leveling shoe and floor runner and is exposed at the bottom of the cabinet whereby the leveling system is not visible from the exterior of the cabinet. It will be understood that a similar finish base member is provided at the opposite face of the cabinet where the storage wall is used as a room divider.

It will be noted that the storage system of the present invention can be positioned against a solid interior wall or can comprise a room divider which is exposed on both sides. In the latter event, the system can be constructed and arranged to provide drawer or door access at both sides of the system, in essentially the same manner as described. If the drawer access is provided at both sides, the depth of the unit will be accommodated or the drawers will be made relatively shorter, either of which modification can be achieved without difficulty.

I claim:

1. A cabinet designed to receive modular interchangeable components to provide drawer, shelf, and/or compartment type storage, comprising:

a. a pluraliy of supporting components interconnected to form a storage area bounded at top, bottom and opposed sides and open at the front, b. a plurality of vertical standards mounted on said supporting components comprising the sides of said storage area, said vertical standards being formed with vertically spaced openings and being in opposed pairs on said sides and including at least two vertical standards on each supporting component in spaced relation, front to rear, on said supporting component, c. at least a pair of drawer guides removably mounted on said standards at a desired vertical level by means which extend through a selected opening in each standard, said drawer guides being mounted in opposed relation on said standards on each supporting component to slidably receive a drawer, d. roller assemblies removably mounted on said vertical standards above said drawer guides, each roller assembly including a roller and being provided with means which extends through a selected opening in each standard, e. a drawer including side walls having drawer roller mounted thereon engageable in said drawer guides when said drawer is mounted for sliding movement in said cabinet, said side walls having associated therewith laterally extending guide flanges shaped and arranged to receive said rollers mounted above said drawer guides, and f. means for supporting and leveling said cabinet on a supporting surface, said supporting means including at least two separate floor runners which extend below said cabinet and are spaced front to rear relative to said cabinet, at least two supporting shoes operatively connected to the bottom supporting component of said cabinet, said supporting shoes being in spaced relation front to rear of said bottom supporting component and vertically aligned with said floor runners, and leveling means carried by said supporting shoes and engageable with said floor runners for supporting said shoes and thus said cabinet above said floor runners, said bottom supporting component being formed with openings for receiving adjustable end portions of said leveling means whereby said cabinet when positioned on said floor runners can be leveled relative to said floor runners and the surface supporting the same.

2. The cabinet of claim 1 wherein said leveling means includes a bottom foot portion engaging said floor runner and a threaded shaft portion extending upwardly through said shoe, the upper end of said shaft portion being constructed to permit rotation of said leveling means from within the cabinet, and meand theadedly received on said shaft and rigidly secured to said shoe, whereby rotation of said leveling means effects vertically upward or downward movement of said cabinet relative to said floor runner so as to permit leveling of said cabinet.

3. The cabinet of claim 2 further including nail means extending downwardly through said floor runners and terminating below the bottom surface of said runners, said nail means engaging the supporting surface and serving to space the bottom of said floor runners from said surface whereby said system can be installed over carpeting without significant damage thereto.

4. The cabinet of claim 2 further including a finish base member mounted below said cabinet and extending over the front edges of said floor runner and shoe to cover the same.

5. The cabinet of claim 1 further including a vertical dividing partition removably mounted in said cabinet between the supporting components comprising the sides of such storage area, and vertical standards mounted on both sides of said partition thereby adapting said cabinet for drawer or shelf storage in compartments defined respectively by said partition and the supporting components comprising the sides of said storage area.

6. The cabinet of claim 1 wherein said standards are generally U-shaped in cross-section and said openings in said vertical standards comprise slots spaced from the supporting component on which said standards are mounted, said drawer guides being formed with tabs extending through said slots for removably mounting said drawer guides on said standards, and wherein said roller assemblies include brackets provided with tabs which extend through said slots, said drawer guides and said brackets being vertically spaced so that said rollers mounted on said brackets engage under said laterally extending flanges on said drawers, and said drawer rollers on said drawers engage in said drawer guides.

7. The cabinet of claim 1 wherein a plurality of pairs of drawer guides are mounted vertically incrementally in opposed relation on said standards, and a pluraliy of drawers are provided corresponding incrementally in height to the spacing of said drawer guides, each of said drawers being provided with drawer rollers engagable in corresponding drawer guides for mounting said drawers for sliding movement in said cabinet.

8. The cabinet of claim 1 wherein the sidewalls of said drawer are formed of metal and said laterally extending guide flanges are formed at the top of said sidewalls.

9. A cabinet designed to receive modular interchangeable components to provide drawer, shelf, and/or compartment type storage, comprising:

a. a plurality of supporting components interconnected to form a storage area bounded at top, bottom and opposed sides and open at the front, b. a plurality of vertical standards mounted on said supporting components comprising the sides of said storage area, and vertical standards being in opposed pairs on said sides, c. at least one door hinged at the front of said cabinet, said hinge being constructed and arranged to permit 180° pivotal movement of said door between open and closed positions, said hinge including mounting sections positioned in openings provided therefor in said door and in the adjoining sidewall of said cabinet, leaf sections constructed and operably connected to said mounting sections so as to allow 180° pivotal movement of said door between opened and closed positions, said mounting sections of said hinge being formed with engaging tabs adapted to be moved from a position wholly within the confines of said mounting sections to a radially outward position in which said tabs are embedded into the walls of said door and said sidewall which define the openings for receiving the mounting sections, and means connected to said tabs accessible at the exposed portions of the mounted hinge for rotating said tab members for installing said hinge or for removing the same from its mounted position, d. shelf bracket means removably mounted in said cabinet for supporting shelves, and e. means for supporting said cabinet on a supporting surface, said supporting means including separate floor runners extending longitudinally of said cabinets and positioned below the front and rear portions thereof, supporting shoes secured to the bottom supporting component of said cabinet above and adapted to be aligned with said floor runners, and leveling means carried by said supporting shoes and engageable with said floor runners for supporting said shoes and thus said cabinet above said floor, said bottom supporting component being formed with openings for receiving adjustable end portions of said leveling means whereby said cabinet can be leveled relative to said floor runners and the surface supporting the same.

10. The cabinet of claim 9 wherein said leveling means including a bottom foot portion engaging said floor runner and a threaded shaft portion extending upwardly through said shoe, the upper end of said shaft portion being constructed to permit rotation of said leveling means, and means threadedly received on said shaft and rigidly secured to said shoe whereby rotation of said leveling means affects vertically upward or downward movement of said cabinet relative to said floor runner so as to permit leveling of said cabinet.

11. The cabinet of claim 9 further including nail means extending downwardly through said floor runners and terminating below the bottom surface of said runners, said nail means engaging the supporting surface and serving to space the bottom of said floor runners from said surface whereby said system can be installed over carpeting without significant damage thereto.

* * * * *